United States Patent [19]

Stöckl

[11] Patent Number: 4,533,106

[45] Date of Patent: Aug. 6, 1985

[54] LIFTING DEVICE FOR A DENTIST CHAIR

[75] Inventor: Klaus Stöckl, Heppenheim, Fed. Rep. of Germany

[73] Assignee: Siemens Aktiengesellschaft, Berlin and Munich, Fed. Rep. of Germany

[21] Appl. No.: 516,212

[22] Filed: Jul. 22, 1983

[30] Foreign Application Priority Data

Aug. 2, 1982 [DE] Fed. Rep. of Germany ..... 3228834

[51] Int. Cl.[3] ..... A61G 15/00

[52] U.S. Cl. ..... 248/421; 297/345

[58] Field of Search ..... 248/421, 584, 588, 371; 182/63; 187/118; 297/345

[56] References Cited

U.S. PATENT DOCUMENTS

| | | | |
|---|---|---|---|
| 3,086,742 | 4/1963 | Severson | 248/588 |
| 3,182,947 | 5/1965 | Tanaka | 248/421 |
| 3,522,925 | 8/1970 | Buchtel | 248/421 |
| 4,295,627 | 10/1981 | Graves | 248/588 |

*Primary Examiner*—Reinaldo P. Machado

*Assistant Examiner*—Alvin Chin-Shue

*Attorney, Agent, or Firm*—Mark H. Jay

[57] ABSTRACT

A lifting device, particularly for a dentist chair incorporating support arms arranged in a scissor form between a base portion and a seat support portion which is height adjustable relative thereto. The scissor action support mechanism comprises two support arms arranged in a single scissor's pair to realize an extremely compact yet rugged design. Each support arm includes two arm parts - a shorter arm and a longer arm - which are joined at one of their ends by a lateral stiffening section. The two support arms are arranged to face each other and are joined by an axle bearing which ties the two shorter arm parts to each other thus creating the scissor lifting structure. The free ends of the longer arms are mounted on lower and upper horizontal guides. A spindle driver applying forces at or near the axle bearing is used for lowering or raising the seat. The scissor arms are fully collapsible and because of the double arm construction a rugged, tension-stiff assembly results.

6 Claims, 7 Drawing Figures

LIFTING DEVICE FOR A DENTIST CHAIR

BACKGROUND OF THE INVENTION

The invention relates to a lifting device, particulary for a dentist chair, with support arms arranged in scissor form between a base portion and a height-adjustable support portion, joined together by an axle, which arms are arranged spaced and parallel to each other in pairs, the one ends of which are articulated at a fixed part, while the other ends are articulated at the movable part of a horizontal guide of the base portion, on the one hand, and of the height-adjustable support portion, on the other.

A lifting device is known for example from U.S. Pat. No. 3,522,925. There, however, the lifting device is designed as a double scissor arm construction with double scissor arms arranged on either side of the chair and connected together by joints.

Such a lifting device is expensive to construct and has relatively many bearing points which, for sufficient stability, must be very precise and are therefore expensive to manufacture. Another disadvantage is attributed to the fact that the scissor arms do not fold to an extreme depth.

SUMMARY OF THE INVENTION

It is the object of the present invention to disclose a simpler, yet sufficiently stable lifting device with a sufficiently high useful stroke and an extremely low bottom position, aiming at a reduction of the width of the support arm construction without an adverse effect on stability.

To achieve this objective, the invention discloses a lifting device with a base portion and a support portion which is height adjustable. The actual lifting mechanism is mounted between the base portion and the height adjustable support portion. The lifting device has a pair of support arms each support arm having two arm parts of unequal length which are joined by a cross reinforcement at one of their ends. In the joined configuration the two arm parts are parallel to each other and separated by the cross reinforcement. The two support arms are positioned to face each other in a side reversed arrangement and the two shorter support arm parts are joined by an axle bearing. The essentially X-shaped scissors action lifting device is pivotally fixed on one side to the base portion and to the support portion while the remaining two ends are slidably mounted onto lower and upper horizontal guides for lateral movement therealong. The lower horizontal guide is fixed to the base portion while the upper guide is fixed to the support portion.

A preferred embodiment shows a spindle drive mechanism which is attachable to one of the support arms for lifting or lowering the support portion.

The lifting device according to the invention provides a very compact construction plan of very small width, which is sufficiently stable and which can be used to special advantage as a height adjusting system for a dentist chair.

Other features and advantages of the invention will be apparent from the following description of the preferred embodiments, and from the claims.

For a full understanding of the present invention, reference should now be made to the following detailed description of the preferred embodiments of the invention and to the accompanying drawings.

DETAILED DESCRIPTION

Figure 1:
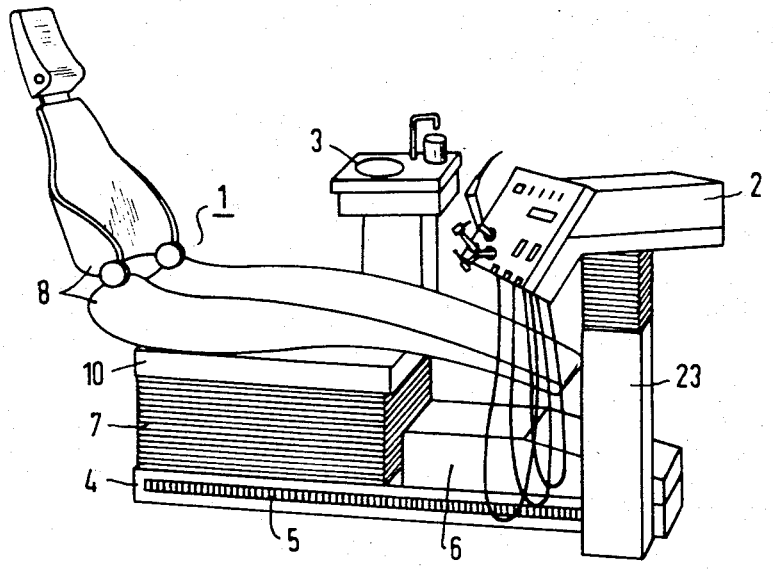
FIG. 1 shows a dentist work station in a perspective representation.
Figure 2:
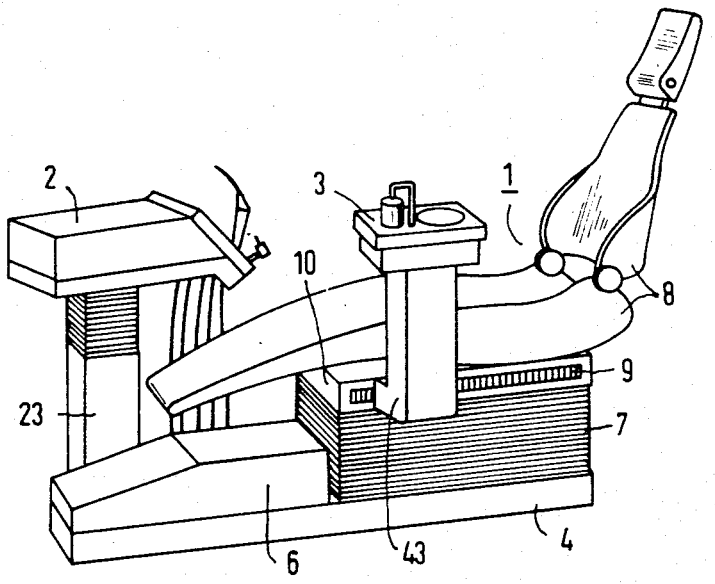
FIG. 2 shows the work station according to FIG. 1 viewed from the opposite side.

FIG. 1 shows in perspective a dentist work station, consisting of a chair 1, a doctor's apparatus 2 disposed to the right thereof viewed from the patient, and an assistant's apparatus 3 disposed to the left of the chair. The chair 1 consists essentially of a top and a bottom. The chair bottom contains a base portion 4, in which are arranged a horizontal guide 5, to be exlained later, for the doctor's apparatus 2, and electrical and/or pneumatic supply components combined in a connection box 6, as well as a height adjusting device covered up by a bellows or accordion 7 for the chair top 8 consisting of the seat and backrest. The apparatus 3 is also mounted for adjustment parallel to the longitudinal axis of the chair by means of a horizontal guide 9 (FIG. 2). But in contrast to the horizontal guide 5 for the doctor's apparatus 2—which extends at the fixed base portion 4 over the full length of the chair, hence approximately from the rear seat edge to at least the foot end of the seat or respectively to what in FIG. 1 is the right end of the connection box 6—the horizontal guide 9 for the assistant's apparatus 3 extends at the vertically adjustable chair top support 10 only over the length thereof.

Figure 3:
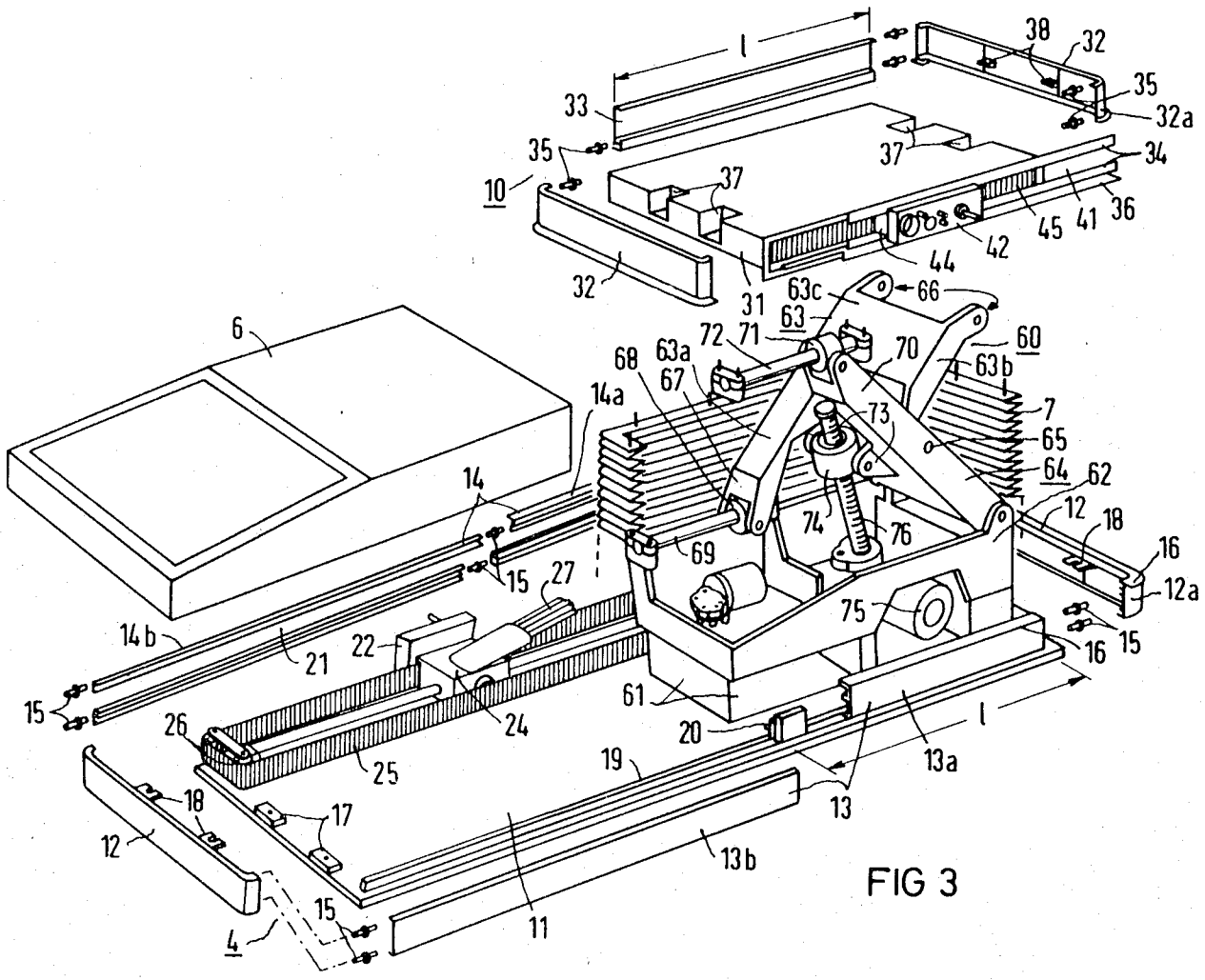
FIG. 3 shows the construction of the chair bottom with the lifting device in an exploded view.

FIG. 3 shows the construction of the chair bottom including the chair top support 10 in an exploded view. The view is taken from the side from which FIG. 2 is to be viewed.

The base portion 4 is formed essentially of a bottom plate 11 of rectangular plan, which receives all carrying parts, in particular the height-adjusting system marked 60 and the support 10 for the chair top 8, and of a frame surrounding the bottom plate 11, which frame in turn is formed by two endpieces 12 on the shorter sides and trim parts 13 on the longer sides as well as sectional elements 14. The endpieces 12 constitute corner sections, i.e. they have end portions 12*a* which are bent at right angles and span the shorter sides of bottom plate 11 and into which the elastic connecting elements 15 are plugged, to which the trim parts 13 or respectively the sectional elements 14 can be attached. The righthand endpiece 12 shown in the figure contains a shoulder 16, where the lower end of the accordion 7 is hooked in. The endpieces 12 are screwed to the bottom plate 11, for which purpose attachment blocks 17 are arranged on the latter, and tabs 18' at the endpieces 12.

The full-area trim parts 13 are transversely divided into a section 13*a*, corresponding substantially to the length of the chair top support 10 or of the accordion 7 embracing the height-adjusting device, and a section 13*b*, which corresponds to the remaining length, essentially the length of the connection box 6. At the joint, a holder 20 is provided which is attached to the base plate 11 or respectively to a strip 19 connected with the latter and is adapted to the contour of the trim parts 13, the trim parts 13*a*, 13*b* being slipped onto said holder by their one ends for fixation before being connected at their other ends with the endpieces 12 by means of the elastic connecting elements 15. The trim part 13*a*, like the right endpiece 12, also has a shoulder 16 where the accordion 7 is hooked in. The transverse division exists also at the angle sections 14. Here, too, the individual parts are connected together by elastic connecting elements 15. The upper angle section 14*a* contains, like the trim part 13*a*, a corresponding shoulder 16, for attachment of the accordion 7.

An essential advantage of the transverse division of the trim parts and angle sections in the manner described is to be seen in that identical trim parts can be used to trim both the seat support and the base portion, and this for a chair design with a short base portion, e.g. without connection box, or with a long base portion, e.g. with connection box.

Over their entire length the two sectional elements 14 form a slit 21, from which a hookup or support portion 22 protrudes, on which the support column 23—bent at the foot—(FIG. 1) for the apparatus 2 can be attached. The hooked portion 22 is firmly connected with a carriage 24 which is guided inside the base portion 4 over the full length of slit 21 in the horizontal guide 5.

In every position of carriage 24, the slit 21 is covered up by a belt 25 hooked in at the carriage 24, which belt is guided as an endless belt over guide rolls 26 in approximately rectangular form. Opening into the carriage 24 are further several supply lines 27 joined together in a flat band, which bring the media required in the apparatus 2 (air and/or water and/or electric current) from a central supply source in the connection box 6 to the hookup portion 22.

Matching the construction of the base portion 4, the chair top support 10 consists of a bottom plate 31 of rectangular shape and of the same width as the bottom plate 11, and of a frame consisting firstly of endpiece 32 on both sides and secondly of trim parts 33 as well as angle sections 34, which in turn are attached at the endpieces by means of corresponding elastic connection elements 35. At the endpieces and at the sectional elements, shoulders 36 are provided, where the accordion 7 can be hooked in.

The endpieces 32 are identical with the endpieces 12, hence at the same point and at the same level they have attachment tabs 38. The respective mounts 37 are provided in the bottom plate 31. Also the trim parts 33 have the same dimensions as the trim sections 13*a*, so that, among other things, inventory of the parts is simlified since the parts are interchangeable. Thus, for example, the right hand endpiece 12 (with shoulder) of the base portion 4 can be used as trim for the top portion support.

Again there extends through the slit 41 formed by the two angle sections 34 a hookup or support part 42, where the support column 43 (FIG. 2) of apparatus 3 is attached either directly or through a support arm. As in the base portion 4, the slit is covered by a belt 45.

Referring to FIGS. 3 to 7, the construction of the lift device for adjustment of the chair top will be explained more specifically.

Integrally formed on the bottom plate 11 of base portion 4 are pedestal parts 61, on which is fastened a box type frame 62 open toward the top and bottom. A scissor arm construction formed of two parts 63, 64 is articulated on the one hand to the frame 62 and on the other to the chair top support 10.

Except for the hinge point of a drive to be explained more specifically later, the scissor arm parts 63, 64 are identical, i.e. they each form a long arm 63*a*, a shorter arm 63*b*, and a cross reinforcement 63*c* lying therebetween. The shorter arm 63*b* and 64*b* are about half as long as the longer arms 63*a* and 64*a* and are joined in a joint axle bearing 65. The ends 66 of the parallel arms 63*a*, 63*b*, ending at the same level, are mounted at the chair top support 10; the free end 67 of the longer arm 63*a* is articulated to a bushing 68, which together with a guide rod 69 fastened on the frame 62 forms a horizontal guide.

The equivalent applies to the scissor arm part 64, whose free end 70 is articulated to a bushing 71, which is guided by a guide rod 72 fastened to the chair top support 10. At the scissor arm part 64 are arranged mounting and bearing parts 73 for a spindle nut 74 which is part of a spindle drive whose drive motor 75 is fastened on the bottom plate 11 and whose spindle 76 engages through the frame 62.

Figure 4:
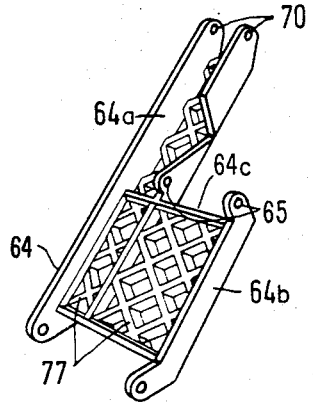
FIG. 4 shows a part of the lifting device in a perspective view.

FIG. 4 shows the scissor arm part 64 from the back. It can be seen from the illustration that both the scissor arm part 64 as such, as well as, the long arm 64*a* are of U-shaped cross-section and that between them diagonally extending and crossing stiffening ribs 77 are provided. This makes the entire scissor arm construction extremely tension-stiff.

Figure 5:
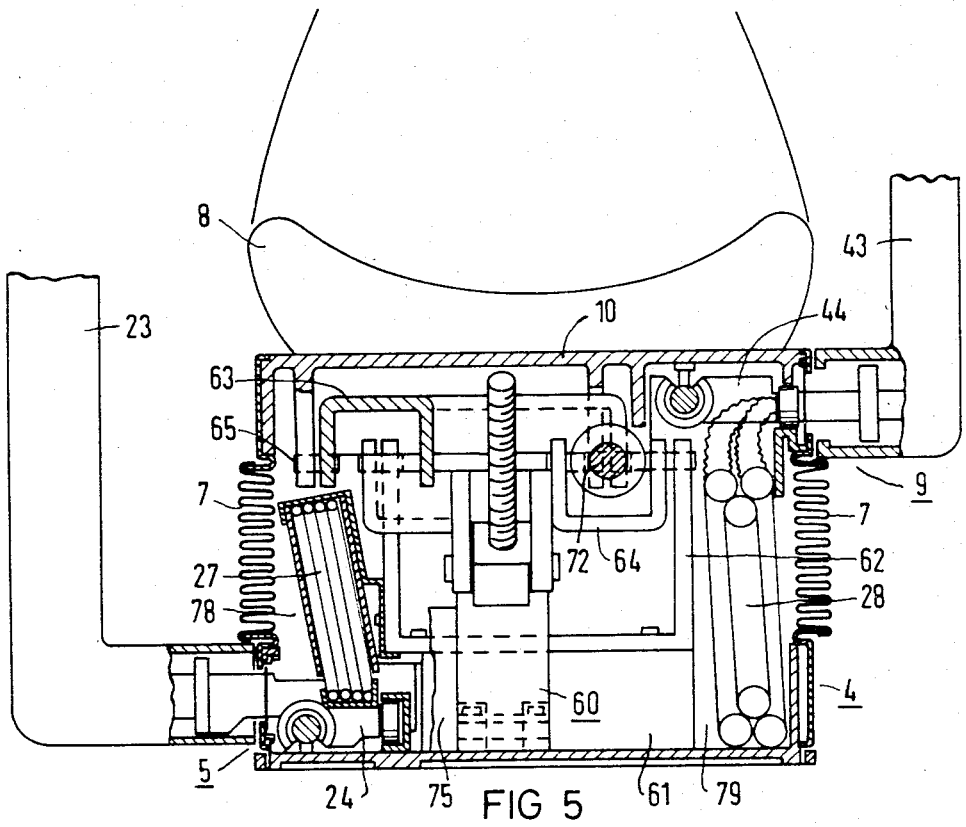
FIG. 5 shows a transverse section of the chair bottom.
Figure 6:
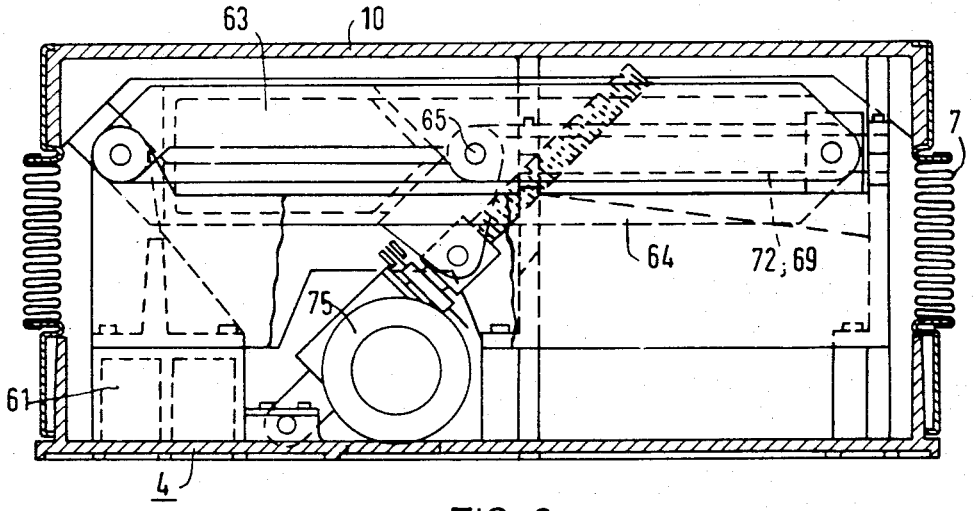
FIGS. 6 and 7 show a side view of the device, on the one hand in a lowered position, and on the other hand in an raised position.
Figure 7:
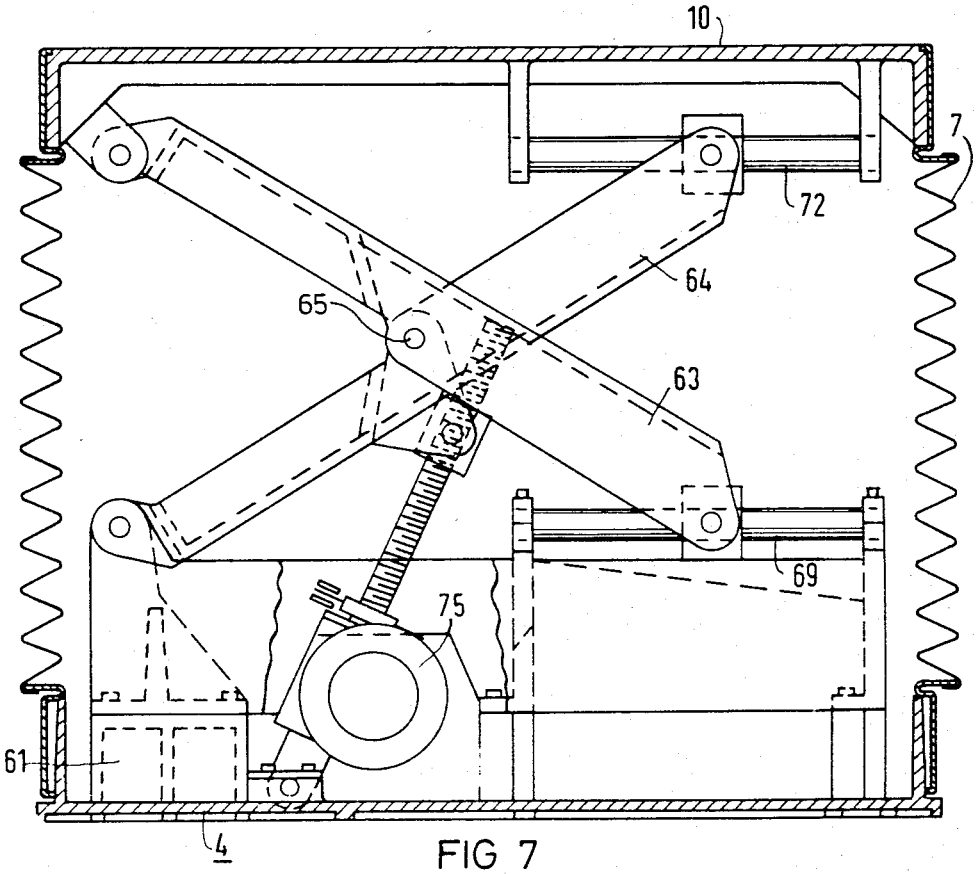

As can be seen from FIGS. 3 and 5, the two scissor arm parts 63 and 64 are arranged relative to each other in such a way that the sides of the U-shaped arms are turned toward each other. Thus the two scissor arm parts can be arranged horizontally in the lowest position (FIG. 6). Through the interengagement of the scissor arm parts even a still lower end position would be possible, should this be necessary for certain structural requirements.

The design of the lift device in the manner described makes it possible to construct an extremely narrow lift device, whereby in comparison with other designs more space is created laterally of the scissor arm parts.

Another advantage is that below the scissor arms lying horizontally in the lowest position sufficient space is left for accommodating the supply lines.

The base portion 4 and chair top support 10 form on either side of the height-adjusting system 60 a free space 78, 79 serving as cable duct for the cables 27 and 28. This free space extends parallel to the longitudinal axis of the chair and is limited on the one hand by the pedestal and frame parts 61, 62 and on the other hand by the bellows or accordion 7. The supply lines 27, 28 are combined in the manner of a flat cable and installed in cable ducts 78, 79 forming a loop, so that they can follow the movement of the apparatus. One end of each of the lines opens into the carriage 24 or respectively 44, hence moving along over the guide track, while the other end opens into the connection box 6. Since, in contrast to the lines 27, the supply lines 28 for the assistant's apparatus 3 must participate not only in the reciprocating movement but also in the height-adjusting movement of the chair top support 10, the length of the lines is here such that in the respective end positions they are still sufficiently guided inside the cable duct.

There has thus been shown and described novel apparatus for a dentist chair lifting mechanism which fulfills all the objects and advantages sought therefor. Many changes, modifications, variations and other uses and applications of the subject invention will, however, become apparent to those skilled in the art after considering this specification and the accompanying drawings which disclose preferred embodiments thereof. All such changes, modifications, variations and others uses and applications which do not depart from the spirit and scope of the invention are deemed to be covered by the invention which is limited only by the claims which follow.

What is claimed is:

1. A scissor action lifting device for a dentist chair with a base portion and a support portion which is height adjustable, said lifting device being mounted between said base portion and said height adjustable support portion which comprises, in combination:

(a) a pair of support arms, each arm having two arm parts, said arm parts comprising a longer arm part and a shorter arm part, said arm parts being joined at the area near one of their respective ends by a cross reinforcement member lying therebetween;

(b) a joint pivotally securing the support arms together in a manner that their shorter arm parts are on one side of the joint and their longer arm parts extend past the joint on another side thereof to form a scissors-type configuration which pivots about a horizontal axis; and (c) upper and lower horizontal guides, each being slidably attached at an end of a corresponding one of the longer arm parts on said another side of said joint, the upper horizontal guide being attached to said support portion and the lower horizontal guide being fixed, whereby application of lifting or lowering forces to at least one of the support arms allows the support portion to be lifted or lowered.

2. Lifting device according to claim 1, wherein said cross reinforcement comprise diagonally extending crossing ribs.

3. Lifting device according to claims 1 or 2, wherein said pair of support arms are identically constructed.

4. Lifting device according to claims 1 or 2, wherein each of said arm parts has a U-shaped cross-section and downwardly extending sides which are parallel to each other, and wherein corresponding sides on corresponding arm parts extend toward each other.

5. Lifting device according to claim 1, wherein said base portion further comprises a bottom plate and wherein said support arms are hinged on a box type frame which is attachable to said bottom plate.

6. Lifting device according to claim 5, further comprising a spindle drive mechanism which is attachable on one end to one of said support arms and to a drive source on its other end, said spindle drive being operative for applying lifting and lowering forces to said lifting device.

* * * * *